US010890059B2

(12) United States Patent
Yang et al.

(10) Patent No.: US 10,890,059 B2
(45) Date of Patent: Jan. 12, 2021

(54) LAYERED WATER INJECTION SYSTEM AND LAYERED WATER INJECTION METHOD

(71) Applicant: PetroChina Company Limited, Beijing (CN)

(72) Inventors: Lingzhi Yang, Beijing (CN); Yafeng Ju, Beijing (CN); Bin Yao, Beijing (CN); Jiuzheng Yu, Beijing (CN); Bilin Luo, Beijing (CN); Fuwei Bi, Beijing (CN); Zijian Wang, Beijing (CN); Yanqing Liu, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 177 days.

(21) Appl. No.: 16/175,620

(22) Filed: Oct. 30, 2018

(65) Prior Publication Data

US 2019/0242226 A1 Aug. 8, 2019

(30) Foreign Application Priority Data

Feb. 7, 2018 (CN) ..... 2018 1 0121734

(51) Int. Cl.
*E21B 43/20* (2006.01)

(52) U.S. Cl.
CPC ..... *E21B 43/20* (2013.01)

(58) Field of Classification Search
CPC ..... E21B 43/20; E21B 47/14; E21B 47/18
See application file for complete search history.

(56) References Cited

U.S. PATENT DOCUMENTS 5,133,411 A 7/1992 Gadelle et al.
7,171,309 B2 * 1/2007 Goodman ..... E21B 47/18 702/6

(Continued)

FOREIGN PATENT DOCUMENTS

CN 1279388 7/1999
CN 1538034 10/2003

(Continued)

OTHER PUBLICATIONS

Chinese Appln. No. 20180121734.3, Office Action (dated Nov. 6, 2019).

(Continued)

*Primary Examiner* — Michael R Wills, III
(74) *Attorney, Agent, or Firm* — Loza & Loza, LLP; Michael F. Fedrick

(57) ABSTRACT

A layered water injection system and a layered water injection method. The system comprises: a ground water injection valve group configured with an intelligent control valve, for receiving a water injection control instruction sent by a remote control center, and for converting the water injection control instruction into a switching action of the intelligent control valve to control water flow pressure fluctuation in a water injection string, so as to form a first pressure wave code in the water injection string; a water distributor for collecting the first pressure wave code, interpreting the first pressure wave code as a corresponding water outlet switch instruction, and performing layered water injection control according to the water outlet switch instruction. The embodiments of the application can improve the automation level of layered water injection and the reliability of layered water injection control.

12 Claims, 4 Drawing Sheets

(56) References Cited

U.S. PATENT DOCUMENTS

| | | | | |
|---|---|---|---|---|
| 9,523,272 | B2 * | 12/2016 | McMillon | E21B 47/14 |
| 9,617,850 | B2 * | 4/2017 | Fripp | E21B 47/18 |
| 10,648,327 | B2 * | 5/2020 | Tinnen | E21B 47/24 |
| 2004/0104027 | A1 * | 6/2004 | Rossi | E21B 43/12 166/250.15 |
| 2009/0034368 | A1 * | 2/2009 | Johnson | E21B 47/14 367/83 |
| 2015/0009039 | A1 * | 1/2015 | Tinnen | E21B 47/18 340/850 |
| 2015/0027715 | A1 * | 1/2015 | Tinnen | G01V 11/002 166/316 |
| 2015/0354351 | A1 * | 12/2015 | Morrow | E21B 47/14 367/82 |
| 2016/0230545 | A1 * | 8/2016 | McMillon | E21B 47/095 |
| 2016/0312579 | A1 * | 10/2016 | Green | E21B 49/08 |
| 2017/0159417 | A1 * | 6/2017 | Schuur | E21B 47/14 |
| 2017/0205260 | A1 * | 7/2017 | Jaaskelain | E21B 47/107 |
| 2019/0154859 | A1 * | 5/2019 | Song | E21B 47/14 |

FOREIGN PATENT DOCUMENTS

| | | | |
|---|---|---|---|
| CN | 1619097 | A | 5/2005 |
| CN | 102418504 | | 9/2010 |
| CN | 102797435 | | 11/2012 |
| CN | 103510945 | A | 1/2014 |
| CN | 104500009 | | 4/2015 |
| CN | 104695917 | A | 6/2015 |
| CN | 105986791 | A | 10/2016 |
| CN | 106150460 | | 11/2016 |
| EP | 0435727 | | 12/1990 |

OTHER PUBLICATIONS

Chinese Appln. No. 20180121734.3, Search Report (dated Nov. 6, 2019).

* cited by examiner

LAYERED WATER INJECTION SYSTEM AND LAYERED WATER INJECTION METHOD

CROSS-REFERENCE TO RELATED APPLICATIONS

This application claims the benefit of priority under 35 5 U.S.C. § 119 from Chinese Patent Application No. 201810121734.3, filed Feb. 7, 2018, the disclosure of which is incorporated herein by reference in its entirety.

TECHNICAL FIELD

The present application relates to the technical field of the oilfield water injection, and in particular, to a layered water injection system and a layered water injection method.

BACKGROUND

Oilfield water injection is one of the most widely used, most effective and economical measures to increase and stabilize production during oilfield development process. As the demand for oilfield development continues to increase, water injection technology is also constantly upgrading. In order to effectively solve inter-layer and intra-layer differences, and to improve the reservoir volume and oil recovery, the industry has proposed the downhole layered water injection technology to realize balanced injection development. At present, the layered water distributors commonly used in layered water injection technology are mostly mechanical downhole water distribution structures. Although the layered water injection process can be realized, there are problems such as complicated manual construction, difficulty in measurement and adjustment, and poor effect of layered water injection.

In order to solve the above problems, some automatic water measurement and adjustment technologies have been introduced. There are two main schemes: one is the underground automatic measurement and adjustment of the water distributor, using the cable car to enter the downhole communication instrument into the downhole to execute short-range communication. The method has the risk of encountering the downhole obstacle and hamper, and the electromagnetic communication in the closed space of the downhole is greatly affected by the water quality and the pipe string, and the success rate is low. The other scheme is presetting cable outside the pipe. The cable pre-installation process requires careful protection of the cable, and the cable is easily damaged. At the same time, for the directional well, the cable damage is serious during the process of entering the downhole, and in addition, for the long-term application in the well, the cable seal is valid for a short period of time.

In summary, there is an urgent need for a technical solution that can automatically realize layered water injection and is stable and reliable.

SUMMARY

Embodiments of the present application is to provide a layered water injection system and layered water injection method, and to improve the automation level of layered water injection and the reliability of layered water injection control.

In order to achieve the above purposes, in one aspect, the embodiment of the present application provides a layered water injection system, comprising:

a ground water injection valve group configured with an intelligent control valve, for receiving a water injection control instruction sent by a remote control center, and for converting the water injection control instruction into a switching action of the intelligent control valve to control water flow pressure fluctuation in a water injection string, so as to form a first pressure wave code in the water injection string; and a water distributor for collecting the first pressure wave code, interpreting the first pressure wave code as a corresponding water outlet switch instruction, and performing layered water injection control according to the water outlet switch instruction.

The layered water injection system according to the embodiment of the present application, wherein the interpreting the first pressure wave code as the corresponding water outlet switch instruction comprises:

drawing a corresponding first pressure wave code pattern according to the first pressure wave code; and matching a corresponding water outlet switch instruction from a preset first wave code pattern set corresponding to different water outlet switch instructions, according to the first pressure wave code pattern.

The layered water injection system according to the embodiment of the present application, wherein the performing layered water injection control according to the water outlet switch instruction comprises:

controlling the opening degree of a water outlet control valve of a water outlet according to the water outlet switch instruction, and monitoring the actual flow rate of the water outlet in real time; and when the actual flow rate does not match a specified flow rate corresponding to the water outlet switch instruction, adjusting the opening degree of the water outlet control valve to cause the actual flow rate matching the specified flow rate.

The layered water injection system according to the embodiment of the present application, wherein the performing layered water injection control according to the water outlet switch instruction further comprises:

controlling the opening degree and a switching action of a water outlet control valve of a water outlet according to the water outlet switch instruction, so as to form a second pressure wave code in the water injection string; and when the water distributor collects the second pressure wave code, drawing a corresponding second pressure wave code pattern according to the second pressure wave code; according to the second pressure wave code pattern, matching a corresponding water distribution result from a preset second wave code pattern set corresponding to different water distribution results, and providing the matched water distribution result to the remote control center.

The layered water injection system according to the embodiment of the present application, wherein the converting the water injection control instruction into a switching action of the intelligent control valve to control water flow pressure fluctuation in the water injection string comprises:

converting the water injection control instruction into the switching action of the intelligent control valve, and collecting flow data in the water injection string;

establishing flow fluctuation waveform according to the flow data, and determining whether the flow fluctuation waveform satisfies the preset waveform requirements; and when the flow fluctuation waveform satisfies the preset waveform requirement, determining that a first pressure waveform code satisfying preset requirement has been established in the water injection string.

The layered water injection system according to the embodiment of the present application, when the flow fluctuation waveform does not satisfy the preset waveform requirement, adjusting the switching action according to the difference between the flow fluctuation waveform and the preset waveform requirement, so as to establish the first pressure waveform code satisfying the preset requirement in the water injection string.

The layered water injection system according to the embodiment of the present application, a wireless communication mode is adopted between the intelligent control valve and the remote control center.

In another aspect, the embodiment of the present application also provides a layered water injection method, comprising:

receiving, by a ground water injection valve group configured with an intelligent control valve, a water injection control instruction sent by a remote control center, and converting the water injection control instruction into a switching action of the intelligent control valve to control water flow pressure fluctuation in a water injection string, so as to form a first pressure wave code in the water injection string; and collecting, a water distributor the first pressure wave code, interpreting the first pressure wave code as a corresponding water outlet switch instruction, and performing layered water injection control according to the water outlet switch instruction.

The layered water injection method according to the embodiment of the present application, wherein the interpreting the first pressure wave code as the corresponding water outlet switch instruction comprises:

drawing a corresponding first pressure wave code pattern according to the first pressure wave code; and matching a corresponding water outlet switch instruction from a preset first wave code pattern set corresponding to different water outlet switch instructions, according to the first pressure wave code pattern.

The layered water injection method according to the embodiment of the present application, wherein the performing layered water injection control according to the water outlet switch instruction comprises:

controlling the opening degree of an included water outlet control valve according to the water outlet switch instruction, and monitoring the actual flow rate of the water outlet in real time;

when the actual flow rate does not match a specified flow rate corresponding to the water outlet switch instruction, adjusting the opening degree of the water outlet control valve to cause the actual flow rate matching the specified flow rate.

The layered water injection method according to the embodiment of the present application, wherein the performing layered water injection control according to the water outlet switch instruction further comprises:

controlling the opening degree and a switching action of an included water outlet control valve according to the water outlet switch instruction, so as to form a second pressure wave code in the water injection string; and correspondingly, the intelligent control valve collects the second pressure wave code, and draws a corresponding second pressure wave code pattern according to the second pressure wave code; according to the second pressure wave code pattern, matches a corresponding water distribution result from a preset second wave code pattern set corresponding to different water distribution results, and provides the matched water distribution result to the remote control center.

The layered water injection method according to the embodiment of the present application, wherein the converting the water injection control instruction into a switching action of the intelligent control valve to control water flow pressure fluctuation in the water injection string comprises:

converting the water injection control instruction into the switching action of the intelligent control valve, and collecting flow data in the water injection string;

establishing flow fluctuation waveform according to the flow data, and determining whether the flow fluctuation waveform satisfies the preset waveform requirements; and when the flow fluctuation waveform satisfies the preset waveform requirement, determining that a first pressure waveform code satisfying the preset requirement has been established in the water injection string.

The layered water injection method according to the embodiment of the present application, when the flow fluctuation waveform does not satisfy the preset waveform requirement, adjusting the switching action according to the difference between the flow fluctuation waveform and the preset waveform requirement, so as to establish the first pressure waveform code satisfying the preset requirement in the water injection string.

The layered water injection method according to the embodiment of the present application, a wireless communication mode is adopted between the intelligent control valve and the remote control center.

As can be seen from the technical solutions provided by the above-mentioned embodiments of the present application, the layered water injection system of the present embodiment includes a ground water injection valve group configured with an intelligent control valve, for receiving a water injection control instruction sent by the remote control center, and for converting the water injection control instruction into a switching action of the intelligent control valve to control water flow pressure fluctuation in the water injection string, so as to form a first pressure wave code in the water injection string; a water distributor may collect the first pressure wave code, interpret the first pressure wave code as a corresponding water outlet switch instruction, and perform layered water injection control according to the water outlet switch instruction. Thus, by taking the pressure wave code as the information and the water flow in the water injection string as the information carrier, the integrated communication and control of the remote control center, the ground and the downhole is realized, and layered measurement and distribution, well management and dynamic monitoring of the water injection well is realized, and a foundation for large data processing and application is laid. Moreover, the embodiments of the present application not only realize the automatic control of layered injection, but also save the communication cable, and avoid the unreliable communication problem caused by cable wear in the wired communication mode in the prior art; moreover, in the embodiments of the present application, the problem of low communication success rate due to the influence of water quality and pipe string in the radio electromagnetic communication mode in the prior art can also be avoided, such that the reliability of layered water injection control is improved.

BRIEF DESCRIPTION OF THE DRAWINGS

To illustrate more clearly the embodiments of the present application or the technical schemes of the prior art, a brief description of the accompanying drawings in the embodiments or the prior art will be given below. Obviously, the accompanying drawings described below are only some embodiments described in this application. For those of ordinary skill in the art, other drawings can also be obtained without any creative labor from these drawings. In the drawings.

DETAILED DESCRIPTION OF THE EMBODIMENTS

In order to make those skilled in the art better understand the technical solutions in the present application, the technical solutions in the embodiments of the present application will be clearly and completely described in the following with reference to the accompanying drawings in the embodiments of the present application. Obviously, the described embodiments are only a part of the embodiments of the present application, but not all of them. All other embodiments obtained by a person of ordinary skill in the art based on the embodiments of the present application without creative work shall fall within the scope of the application.

Figure 1:
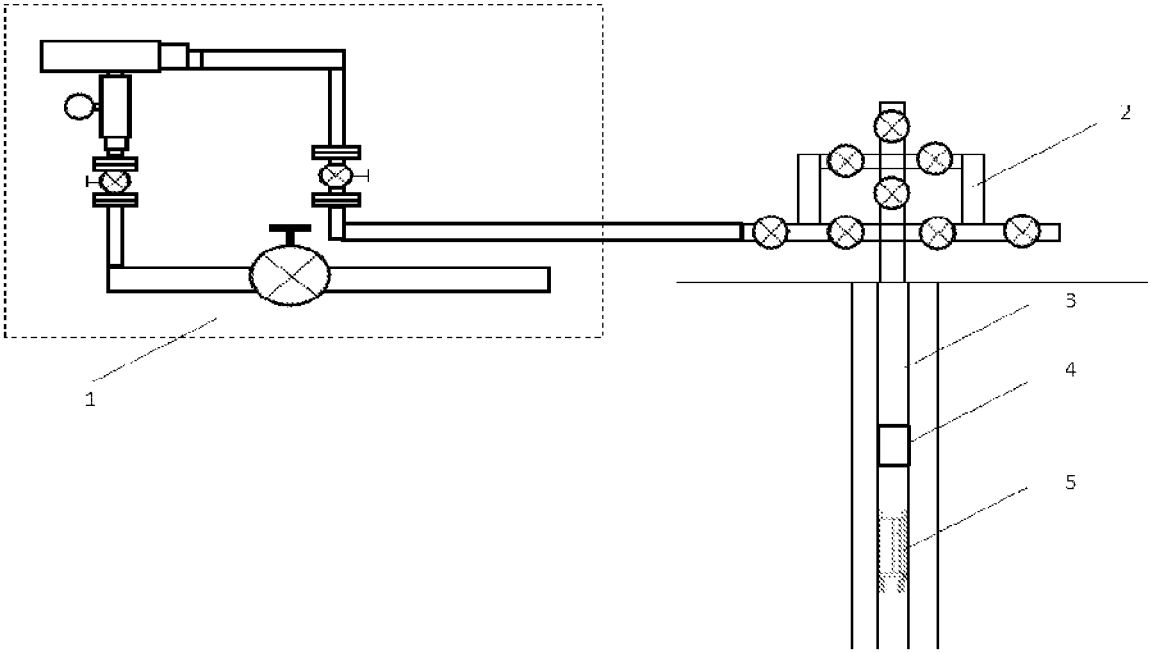
FIG. 1 is a schematic diagram of the layered water injection system according to one embodiment of the present application.

As shown in FIG. 1, the layered water injection system of the present embodiment may include a ground water injection valve group 1, a high pressure water injection wellhead 2, a water injection string 3, and a separate injection well packer 4 coupled in turn. A water distributor 5 is configured on the water injection string 3. Among these elements, threaded connections can be used.

In one embodiment of the present application, the ground water injection valve group 1 is mainly used for receiving a water injection control instruction sent by a remote control center, and for wirelessly communicating with the water distributor 5 using pressure wave codes according to the water injection control instruction. The water in the water injection string 3 serves as a medium for pressure wave code transmission, thus realizing the high-pressure water in the upstream water injection process flowing smoothly into the injection well, and the injection rate of the whole well being controlled to satisfy the injection distribution requirements. The ground injection valve group 1 can communicate with the remote control center by wireless communication.

In one embodiment of the present application, the ground injection valve group 1 may include an intelligent control valve and a high-pressure water injection manifold. The intelligent control valve can be used to receive water injection control instructions, convert the water injection control instruction into a switching action of the intelligent control valve to control water flow pressure fluctuation in the water injection string 3, so as to form a first pressure wave code in the water injection string 3. For example, when the intelligent control valve is opened, the water injection string 3 is in a normal water injection state, and the pressure inside the water injection string 3 rises; when the intelligent control valve is closed, the pressure inside the water injection string 3 is not supplemented, and the pressure is released through the outlet of the water distributor 5, resulting in the decline of the pressure inside the water injection string 3. Thus, the pressure fluctuation of the water flow in the water injection string 3 can be controlled through the above process, thereby forming a first pressure wave code in the water injection string 3.

In one embodiment of the present application, wherein the converting the water injection control instruction into a switching action of the intelligent control valve to control water flow pressure fluctuation in the water injection string 3 may include following steps.

Firstly, converting the water injection control instruction into the switching action of the intelligent control valve, and collecting flow data in the water injection string 3.

Figure 4:
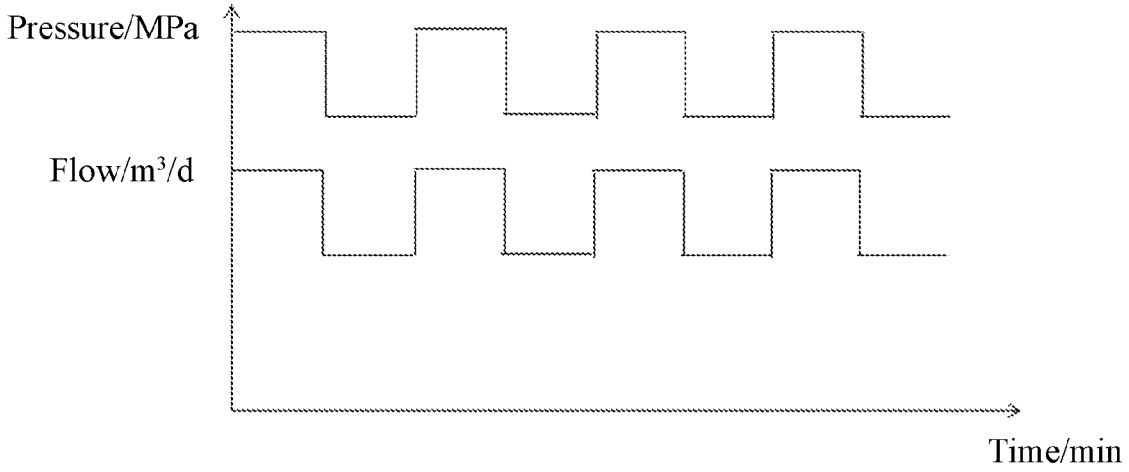
FIG. 4 is a schematic diagram of double carrier control waveforms of pressure and flow according to one embodiment of the present application.

Secondly, establishing flow fluctuation waveform according to the flow data, and determining whether the flow fluctuation waveform satisfies the preset waveform requirements; and when the flow fluctuation waveform satisfies the preset waveform requirement, determining that a first pressure waveform code satisfying the preset requirement has been established in the water injection string 3. In one embodiment of the present application, since the diameter of the water injection string 3 and the density of the injected water are determined, the pressure in the water injection string 3 is positively correlated with the flow rate. Therefore, when the flow pressure fluctuation occurs in the water injection string 3, the corresponding flow fluctuation will occur synchronously, as shown in FIG. 4; and since the flow fluctuation is more significant than the pressure fluctuation, for the convenience of implementation, the embodiment of the present application can indirectly determine whether a first pressure wave code satisfying the preset waveform requirement has been established in the water injection column 3 through determining whether the flow fluctuation waveform satisfies the preset waveform requirements.

Certainly, whether the first pressure wave code satisfying the preset requirement has been established in the water injection string 3 can be determined by the remote control center and the intelligent control valve. In this case, the intelligent control can provide the collected flow data to the remote control center, and the judgment logic can be realized by the remote control center. Correspondingly, when the flow fluctuation waveform does not satisfy the preset waveform requirement, according to the difference between the flow fluctuation waveform and the preset waveform requirement, corresponding control instruction is output to the intelligent control valve. The intelligent control valve adjusts the switching action according to the control instruction, so as to establish the first pressure wave code satisfying the requirement in the water injection string 3.

In one embodiment of the present application, the first pressure wave code established in the injection pipe string 3 is transmitted in the water pipe string 3 using water as a medium, and accordingly, the water distributor 5 can be used to collect the first pressure wave code, interpret the first pressure wave code as the corresponding outlet switch instruction, and perform the layered water injection control according to the outlet switch instruction, so that the wireless communication between the intelligent control valve and the water distributor 5 can be carried out by means of pressure wave code, and the layered water injection control can be achieved through this wireless communication mode.

In one embodiment of the present application, the first pressure wave code described above is interpreted as a corresponding outlet switch instruction, which may include the following steps.

Firstly, drawing a corresponding first pressure wave code pattern according to the first pressure wave code;

Secondly, matching a corresponding water outlet switch instruction from a preset first wave code pattern set corresponding to different water outlet switch instructions, according to the first pressure wave code pattern. Multiple first pressure wave code patterns are preset in the first wave code pattern set, and each first pressure wave code pattern uniquely corresponds to an outlet switch instruction. If a corresponding first pressure wave code pattern is drawn according to a first pressure wave code, and a preset first pressure wave code matching the first pressure wave code pattern is found from the first wave code pattern set, a corresponding outlet switch instruction may be determined, by the corresponding relationship between the preset first pressure wave code pattern and the outlet switch instruction, thereby the first pressure wave code is interpreted as the corresponding outlet switch instruction.

In one embodiment of the present application, the above-mentioned performing layered water injection control according to the water outlet switch instruction may include the following steps.

Firstly, controlling the opening degree of the water outlet control valve according to the water outlet switch instruction, and monitoring the actual flow rate of the water outlet in real time.

Secondly, when the actual flow rate does not match a specified flow rate corresponding to the water outlet switch instruction, adjusting the opening degree of the water outlet control valve to cause the actual flow rate matching the specified flow rate.

In one embodiment of the present application, the performing layered water injection control according to the water outlet switch instruction may further include following steps.

Firstly, controlling the opening degree and a switching action of the water outlet control valve according to the water outlet switch instruction, so as to form a second pressure wave code in the water injection string 3.

Secondly, correspondingly, the intelligent control valve collects the second pressure wave code, and draws a corresponding second pressure wave code pattern according to the second pressure wave code; according to the second pressure wave code pattern, matches a corresponding water distribution result from a preset second wave code pattern set corresponding to different water distribution results, and provides the matched water distribution result to the remote control center. As such, the remote control center learns the water distribution results of the downhole. It should be noted that since the pressure fluctuation corresponding to the second pressure wave code is much smaller than that corresponding to the first pressure wave code, the intelligent control valve needs to collect the second pressure wave code through a highly sensitive pressure sensor.

In one embodiment of the present application, the above-mentioned wave code pattern matching is not limited to two identical comparison patterns, but emphasizes that the waveform change trend is consistent or substantially consistent.

It can be seen that compared with the prior art, the embodiments of the present application not only realizes the automatic control of layered injection, but also saves the communication cable, and avoids the communication unreliable due to cable wear in the wired communication mode in the prior art. In addition, in the embodiments of the present application, the problem of low communication success rate caused by water quality, pipe string, and the like in wireless electromagnetic communication mode in the prior art can be avoided; thereby the reliability of the layer water injection control is improved.

Figure 2:
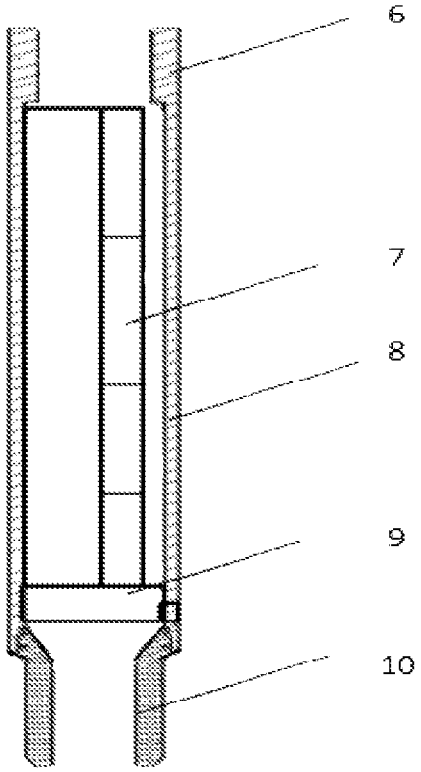
FIG. 2 is a schematic diagram of a water distributor in the layered water injection system shown in FIG. 1.

As shown in FIG. 2, in one embodiment of the present application, the water distributor 5 may include an outer casing 8. The outer casing 8 is provided with an upper joint 6 and a lower joint 10 for connecting with the water injection string 3. The outer casing 8 is configured to include an integrated control unit 7, a support base and water outlet 9. Among which, the integrated control unit 7 can be used to implement the above control of the water distributor 5.

Figure 3:
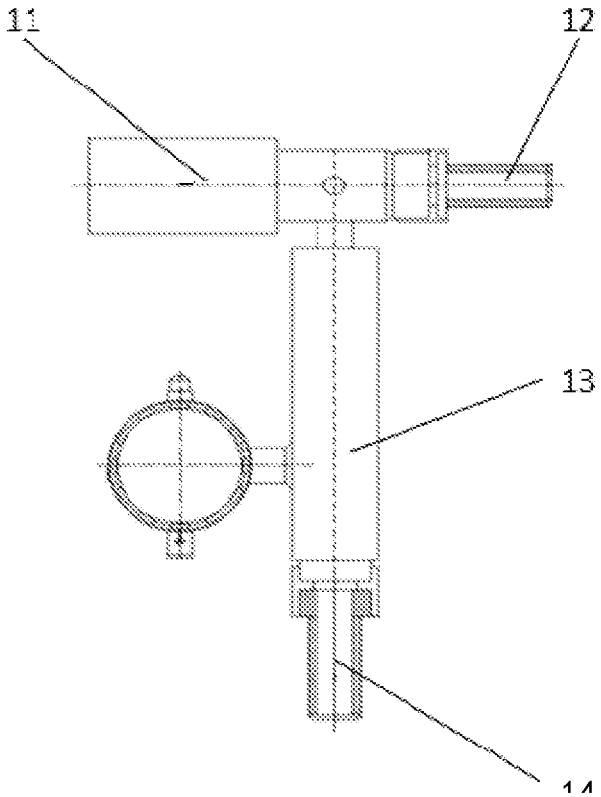
FIG. 3 is a schematic diagram of an intelligent control valve in the layered water injection system shown in FIG. 1.

As shown in FIG. 3, in one embodiment of the present application, the intelligent control valve may be a high-voltage electric control valve 11. The high-voltage electric control valve 11 is configured with a flow meter and control module 13, and an upper joint 12 and the lower joint 14 for connecting the high pressure water injection manifold.

Figure 5:
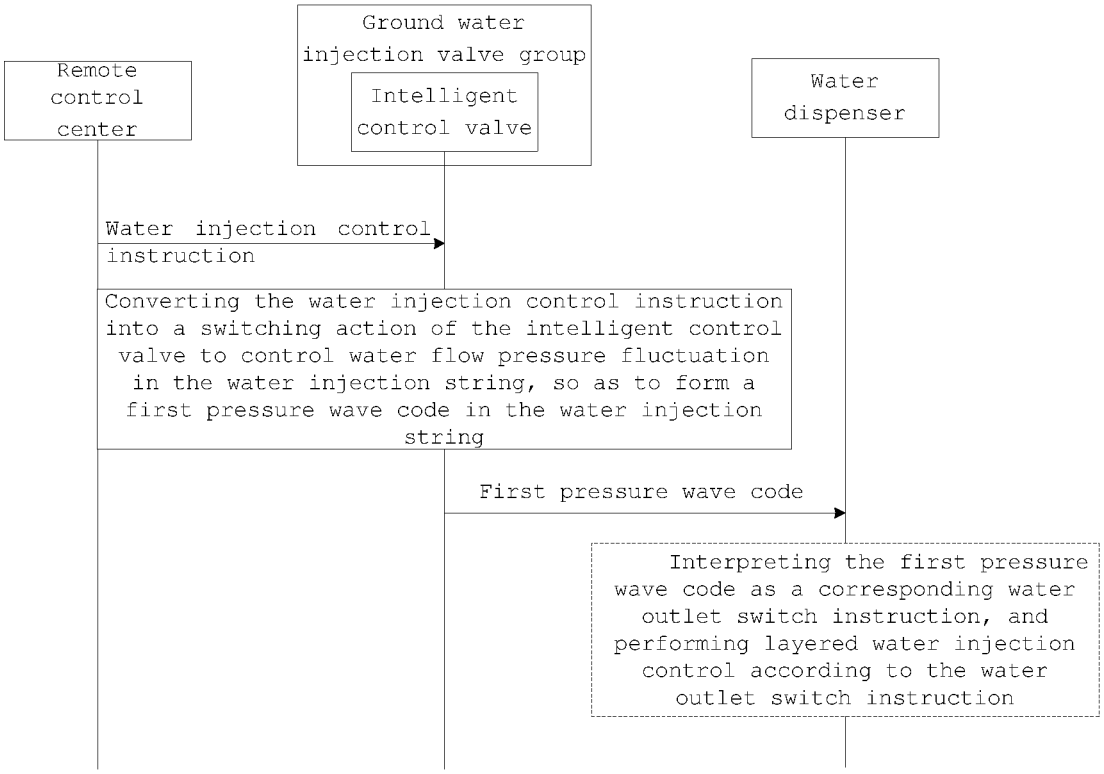
FIG. 5 is an interactive flow chart of the layered water injection method according to one embodiment of the present application.

In one embodiment of the present application, based on the layered water injection system, a layered water injection method of the embodiment of the present application can be referred to FIG. 5. In FIG. 5, a ground water injection valve group configured with an intelligent control valve receives a water injection control instruction sent by the remote control center, and converts the water injection control instruction into a switching action of the intelligent control valve, to control water flow pressure fluctuation in the water injection string and to form a first pressure wave code in the water injection string; then a water distributor collects the first pressure wave code, interprets the first pressure wave code as a corresponding water outlet switch instruction, and performs layered water injection control according to the water outlet switch instruction.

It is also to be understood that the terms "comprise" or "include" or any other variations are intended to contain a non-exclusive inclusion, such that a process, method, product, or equipment comprising a series of elements not only includes the listed elements, but also includes other elements that are not explicitly listed, or elements that are inherent to such a process, method, product, or equipment. An element that is defined by the phrase "comprising a . . . " does not exclude the presence of additional elements in the process, method, product, or equipment that comprises the element.

The various embodiments in the specification are described in a progressive manner, and the same or similar parts between the various embodiments may be referred to each other, and each embodiment focuses on the differences from the other embodiments. In particular, for the method embodiment, since it is basically similar to the system embodiment, the description is relatively simple, and the relevant parts can be referred to the description of the system embodiment.

The above descriptions are only embodiments of the present application and are not intended to limit the application. Various changes and modifications can be made to the present application by those skilled in the art. Any modifications, equivalents, improvements, etc. made within the spirit and scope of the present application are intended to be included within the scope of the claims of the present application.

What is claimed is:

1. A layered water injection system, comprising:

a ground water injection valve group configured with an intelligent control valve, for receiving a water injection control instruction sent by a remote control center, and for converting the water injection control instruction into a switching action of the intelligent control valve to control water flow pressure fluctuation in a water injection string, so as to form a first pressure wave code in the water injection string; and a water distributor for collecting the first pressure wave code, interpreting the first pressure wave code as a corresponding water outlet switch instruction, and performing layered water injection control according to the water outlet switch instruction, wherein converting the water injection control instruction into a switching action of the intelligent control valve to control water flow pressure fluctuation in the water injection string comprises:

converting the water injection control instruction into the switching action of the intelligent control valve, and collecting flow data in the water injection string, and establishing a flow fluctuation waveform according to the flow data, and determining whether the flow fluctuation waveform satisfies the preset waveform requirements, and when the flow fluctuation waveform does not satisfy the preset waveform requirement, adjusting the switching action according to the difference between the flow fluctuation waveform and the preset waveform requirement, so as to establish the first pressure waveform code satisfying the preset requirement in the water injection string.

2. The layered water injection system according to claim 1, wherein interpreting the first pressure wave code as the corresponding water outlet switch instruction comprises:

drawing a corresponding first pressure wave code pattern according to the first pressure wave code; and matching a corresponding water outlet switch instruction from a preset first wave code pattern set corresponding to different water outlet switch instructions, according to the first pressure wave code pattern.

3. The layered water injection system according to claim 1, wherein performing layered water injection control according to the water outlet switch instruction comprises:

controlling the opening degree of a water outlet control valve of a water outlet according to the water outlet switch instruction, and monitoring the actual flow rate of the water outlet in real time; and when the actual flow rate does not match a specified flow rate corresponding to the water outlet switch instruction, adjusting the opening degree of the water outlet control valve to cause the actual flow rate matching the specified flow rate.

4. The layered water injection system according to claim 1, wherein performing layered water injection control according to the water outlet switch instruction comprises:

controlling the opening degree and a switching action of a water outlet control valve of a water outlet according to the water outlet switch instruction, so as to form a second pressure wave code in the water injection string; and when the water distributor collects the second pressure wave code, drawing a corresponding second pressure wave code pattern according to the second pressure wave code; according to the second pressure wave code pattern, matching a corresponding water distribution result from a preset second wave code pattern set corresponding to different water distribution results, and providing the matched water distribution result to the remote control center.

5. The layered water injection system according to claim 1, wherein converting the water injection control instruction into a switching action of the intelligent control valve to control water flow pressure fluctuation in the water injection string further comprises when the flow fluctuation waveform satisfies the preset waveform requirement, determining that a first pressure waveform code satisfying preset requirement has been established in the water injection string.

6. The layered water injection system according to claim 1, wherein a wireless communication mode is adopted between the intelligent control valve and the remote control center.

7. A layered water injection method, comprising:

receiving, by a ground water injection valve group configured with an intelligent control valve, a water injection control instruction sent by the remote control center, and converting the water injection control instruction into a switching action of the intelligent control valve to control water flow pressure fluctuation in a water injection string, so as to form a first pressure wave code in the water injection string; and collecting, by a water distributor, the first pressure wave code, interpreting the first pressure wave code as a corresponding water outlet switch instruction, and performing layered water injection control according to the water outlet switch instruction, wherein converting the water injection control instruction into a switching action of the intelligent control valve to control water flow pressure fluctuation in the water injection string comprises:

converting the water injection control instruction into the switching action of the intelligent control valve, and collecting flow data in the water injection string, establishing flow fluctuation waveform according to the flow data, and determining whether the flow fluctuation waveform satisfies the preset waveform requirements, and when the flow fluctuation waveform does not satisfy the preset waveform requirement, adjusting the switching action according to the difference between the flow fluctuation waveform and the preset waveform requirement, so as to establish the first pressure waveform code satisfying the preset requirement in the water injection string.

8. The layered water injection method according to claim 7, wherein interpreting the first pressure wave code as the corresponding water outlet switch instruction comprises:

drawing a corresponding first pressure wave code pattern according to the first pressure wave code; and matching a corresponding water outlet switch instruction from a preset first wave code pattern set corresponding to different water outlet switch instructions, according to the first pressure wave code pattern.

9. The layered water injection method according to claim 7, wherein performing layered water injection control according to the water outlet switch instruction comprises:

controlling the opening degree of an included water outlet control valve according to the water outlet switch instruction, and monitoring the actual flow rate of the water outlet in real time; and when the actual flow rate does not match a specified flow rate corresponding to the water outlet switch instruction, adjusting the opening degree of the water outlet control valve to cause the actual flow rate matching the specified flow rate.

10. The layered water injection method according to claim 7, wherein performing layered water injection control according to the water outlet switch instruction further comprises:

controlling the opening degree and a switching action of an included water outlet control valve according to the water outlet switch instruction, so as to form a second pressure wave code in the water injection string;

wherein, correspondingly, the intelligent control valve collects the second pressure wave code and draws a corresponding second pressure wave code pattern according to the second pressure wave code; and wherein, according to the second pressure wave code pattern, the intelligent control valve matches a corresponding water distribution result from a preset second wave code pattern set corresponding to different water distribution results, and provides the matched water distribution result to the remote control center.

11. The layered water injection method according to claim 7, wherein converting the water injection control instruction into a switching action of the intelligent control valve to control water flow pressure fluctuation in the water injection string further comprises when the flow fluctuation waveform satisfies the preset waveform requirement, determining that a first pressure waveform code satisfying preset requirement has been established in the water injection string.

12. The layered water injection method according to claim 7, wherein a wireless communication mode is adopted between the intelligent control valve and the remote control center.

* * * * *